US008737034B2

(12) United States Patent
Gietler et al.

(10) Patent No.: US 8,737,034 B2
(45) Date of Patent: May 27, 2014

(54) DETERMINING A CHANGE IN THE ACTIVATION STATE OF AN ELECTROMAGNETIC ACTUATOR

(75) Inventors: Herbert Gietler, Villach (AT); Heinz Zitta, Drobollach (AT)

(73) Assignee: Infineon Technologies AG, Neubiberg (DE)

( * ) Notice: Subject to any disclaimer, the term of this patent is extended or adjusted under 35 U.S.C. 154(b) by 580 days.

(21) Appl. No.: 12/686,851

(22) Filed: Jan. 13, 2010

(65) Prior Publication Data

US 2011/0170224 A1 Jul. 14, 2011

(51) Int. Cl.
*H01H 47/00* (2006.01)

(52) U.S. Cl.
USPC ..... 361/139

(58) Field of Classification Search
USPC ..... 361/139
See application file for complete search history.

(56) References Cited

U.S. PATENT DOCUMENTS

| | | | | |
|---|---|---|---|---|
| 5,784,245 | A * | 7/1998 | Moraghan et al. | 361/154 |
| 7,112,900 | B2 * | 9/2006 | Brotto | 307/326 |
| 7,461,569 | B2 * | 12/2008 | Bianchi | 74/335 |
| 2003/0038263 | A1 | 2/2003 | Battistini et al. | |
| 2007/0135260 | A1 * | 6/2007 | Bianchi | 477/72 |
| 2008/0283352 | A1 | 11/2008 | Purvines | |

* cited by examiner

*Primary Examiner* — Dharti Patel
(74) *Attorney, Agent, or Firm* — Slater & Matsil, L.L.P.

(57) ABSTRACT

A method determines a change in the activation state of an electromagnetic actuator.

19 Claims, 7 Drawing Sheets

DETERMINING A CHANGE IN THE ACTIVATION STATE OF AN ELECTROMAGNETIC ACTUATOR

TECHNICAL FIELD

Embodiments of the present disclosure relate to a method and a circuit arrangement for determining a change in the activation state of electromagnetic actuators.

BACKGROUND

Electromagnetic actuators are electrically controlled mechanical actuators and serve to transform electrical energy into mechanical energy or movement. They include an electromagnet having terminals for applying an electrical voltage thereto, and a movable anchor that can be displaced by the electromagnet. Electromagnetic actuators are used, for example, in relays for switching electrical contacts, or in magnetic valves for opening and closing the valves. Magnetic valves are, for example, used as injection valves in internal combustion machines, or for controlling liquid flow in a clutch system.

The electromagnetic actuator is switched on by applying an on-voltage at its input terminals and is switched off by applying an off-voltage at its input terminals. For switching the electromagnetic actuator, i.e., for applying the on- and off-voltages, a semiconductor switch, such as a MOSFET or an IGBT, may be used. The semiconductor switch is connected in series to the electromagnetic actuator, with the series circuit being connected between supply voltage terminals. Some systems, such as internal combustion machines, employing electromagnetic actuators require an exact control of the activation and deactivation times of the actuators. One problem arising in this connection is a delay time between the time of electrically switching the actuator and the time when an activation state changes. The time when the activation state changes is the time when the actuator "mechanically switches" the anchor, i.e., the time when the anchor is displaced.

In fluid systems having an electromagnetically actuated valve a flow sensor may be employed to detect a change in the activation state. The flow sensor measures a gas or liquid flow through the valve and, therefore, provides information on the times of opening and closing the valve. However, providing a flow sensor increases the overall costs of the system employing the electromagnetic actuator, and increases the number of mechanical components in the system.

There is therefore a need for exactly determining a change in the activation state of an electromagnetic actuator at low cost.

SUMMARY OF THE INVENTION

A first aspect of the present disclosure relates to a method for determining a change in the activation state of an electromagnetic actuator, the electromagnetic actuator includes an electromagnet having an inductance, and an anchor mechanically controlled by the electromagnet. The method involves evaluating an inductance value of the inductance over time.

A second aspect relates to a circuit arrangement including: an electromagnetic actuator, the electromagnetic actuator including an electromagnet having an inductance, and an anchor mechanically controlled by the electromagnet; an evaluation circuit coupled to the electromagnet, the evaluation circuit being adapted to generate an activation state signal dependent on the inductance value of the inductance, the activation state signal being indicative of a change in the activation state of the electromagnetic actuator.

BRIEF DESCRIPTION OF THE DRAWINGS

Examples will now be explained with reference to the drawings. The drawings serve to illustrate the basic principle, so that only aspects necessary for understanding the basic principle are illustrated. The drawings are not to scale. In the drawings the same reference characters denote like.

DETAILED DESCRIPTION OF ILLUSTRATIVE EMBODIMENTS

Figure 1:
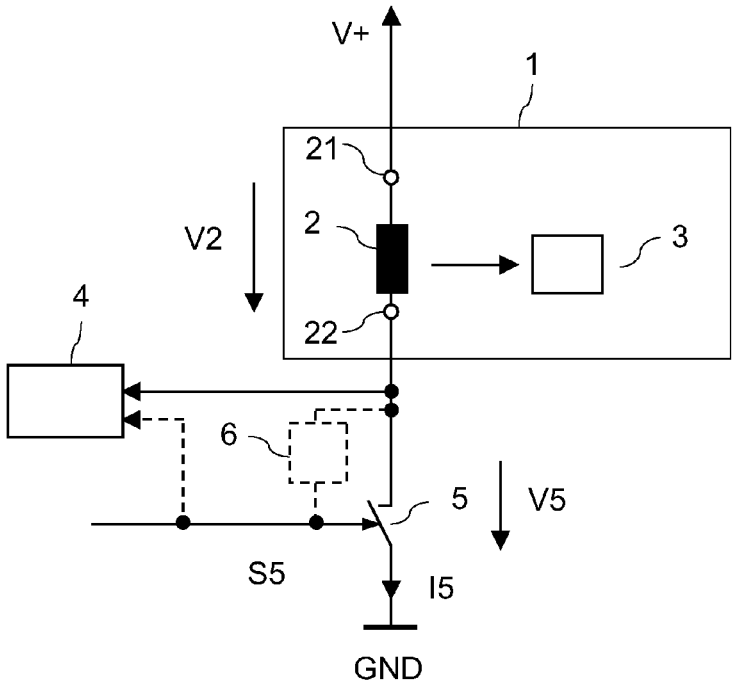
FIG. 1 schematically illustrates a circuit arrangement that includes an electromagnetic actuator, a switching element, and an evaluation circuit for detecting changes in the actuation state of the electromagnetic actuator.

FIG. 1 schematically illustrates a circuit arrangement that includes an electromagnetic actuator 1. The actuator 1 includes an electromagnet 2 connected between input terminals 21, 22 and a mechanical actuator 3 that is actuated by the electromagnet 2. In the example according to FIG. 1 electromagnet 2 and mechanical actuator 3 are only schematically illustrated. The electromagnetic actuator 1 can assume one of an on-state and an off-state. In the on-state an on-voltage is applied between the input terminals 21, 22 of the electromagnetic 2, the on-voltage causing the electromagnet 2 to activate the mechanical actuator 3. In the off-state an off-voltage is applied between the input terminals 21, 22, the off-voltage causing the electromagnet 2 to deactivate the mechanical actuator 3. For applying the on- and off-voltages the circuit arrangement includes a switching arrangement. The switching arrangement according to the present example includes a switching element 5. The switching element 5 includes a load path and a control terminal, the load path being connected in series with the electromagnet 2, with the series circuit including the electromagnet 2 and the switching element 5 being connected between a first and a second voltage supply terminal. In the example according to FIG. 1 the first supply terminal is a terminal for a positive supply potential V+, while the second supply terminal is a terminal for negative supply potential, or a reference potential GND, such as mass, respectively. For the purpose of explanation it is assumed that the second supply potential GND is a reference potential. In this case a supply voltage between the first and second supply terminals corresponds to the positive supply potential V+.

In the example according to FIG. 1 switching element 5 acts as a low-side switch, which means that the switching element is connected between the electromagnet 2 and the negative supply potential GND. However, this is only an example. In another embodiment (not illustrated) switching element 5 acts as a high-side switch. In this case the switching element is connected between the electromagnet 2 and the terminal for the positive supply potential V+.

Switching element 5 receives a control signal S5 at its control terminal, control signal S5 controlling a switching state of switching element 5. Depending on the switching signal S5, switching element 5 assumes one of an on-state or an off-state. In its on-state switching element 5 is switched on, thereby applying the supply voltage V+ that is present across the series circuit including the electromagnet 2 and the switching element 5 to the input terminals 21, 22. In its off-state switching element 5 is switched off, thereby switching off the supply voltage at the input terminals 21, 22. In the circuit arrangement according to FIG. 1 the on-state of the switching element 5 corresponds to the on-state of the electromagnetic actuator 1, and the off-state of the switching element 5 corresponds to the off-state of the electromagnetic actuator.

In known electromagnetic actuators there is usually a delay time between the beginning of the on-state, which is the time when the supply voltage is switched on at the input terminals, and an actuation time when the electromagnet 2 activates the mechanical actuator 3. Equivalently there is a delay time between the beginning of the off-state, which is the time when the supply voltage is switched off at the input terminals, and the time when the electromagnet 2 deactivates the mechanical actuator 3. The first delay time is due to the fact that in the on-state energy has to be stored in the electromagnet 2 before the mechanical actuator 3 is actuated. The second delay time is due to the fact that the energy that has been stored in the electromagnet 2 needs to dissipate before the mechanical actuator 3 is deactivated. Further, there is a delay due to the mechanical movement of the anchor form its start position (the position in the off-state) to its end-position (the position in the on-state), and back.

However, there are systems, such as a closed control loop, like a control loop for controlling fluid flow in a fluid system, where the times when a change in the activation state occurs need to be known exactly, in order to obtain an accurate control result.

For detecting the times when the electromagnet 2 activates and deactivates the mechanical actuator 3, i.e. for detecting times when changes in the activation state occur, the circuit arrangement of FIG. 1 includes an evaluation circuit 4. Evaluation circuit 4 is coupled to the electromagnet 2 and is adapted to detect changes in the activation state by evaluating an inductance value of an inductance of the electromagnet 2.

Figure 2:
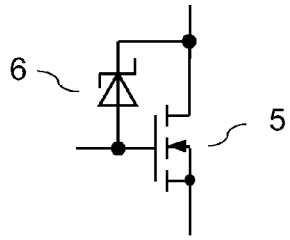
FIG. 2 illustrates a switching element implemented as a MOSFET having a voltage clamping diode.
Figure 3:
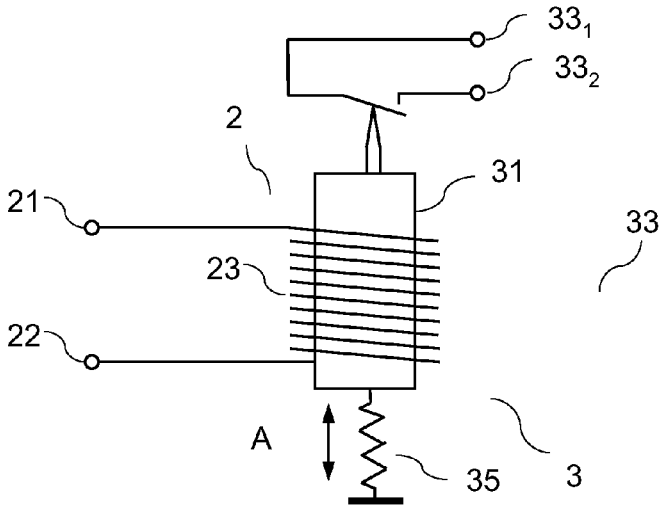
FIG. 3 schematically illustrates a first example of an electromagnetic actuator, the actuator including an electromagnet, and including an anchor for switching electrical contacts.

Before the operating principle of the evaluation circuit 4 will be explained in more detail two examples of electromagnetic actuators will be explained with reference to FIGS. 3 and 4. FIG. 3 schematically illustrates a first example of an electromagnetic actuator. The electromagnet 2 of the electromagnetic actuator includes a coil 23 coupled to the input terminals 21, 22. Coil 23 is wound around an anchor 31, with the anchor 31 being movable in a longitudinal direction in a space defined by coils 23. It should be noted that FIG. 2 only schematically illustrates the arrangement including coil 23 and anchor 31. Support means for holding anchor 31 within the coil 23 are not shown. Further, coil 23 may be wound around a core, with anchor 31 in this case being arranged inside the core and being movable relative to the core in a longitudinal direction.

The electromagnetic actuator according to FIG. 3 further includes a mechanical switch 33 that is actuated by the anchor 31. It should be mentioned that FIG. 3 only schematically illustrates the basic principle of an electromagnetic actuator. In the example illustrated anchor 31 directly actuates switch 33. It goes without saying that additional actuating means (not shown) may be arranged between the anchor 31 and the switch 33, these actuating means serving for converting a mechanical movement of the anchor 31 into a change in the switching position of the switch 33. Mechanical switch 33, that is only schematically illustrated in FIG. 2, is connected between further input terminals $\mathbf{33}_1$, $\mathbf{33}_2$ and may serve for switching an electrical load (not shown).

The operating principle of the electromagnetic actuator according to FIG. 3 will now shortly be explained. In the on-state, i.e., upon applying an on-voltage between the input terminals 21, 22, a current flows through coil 23 of the electromagnet 2. The current flowing through coil 23 generates a magnetic field that causes anchor 31 to be displaced from a starting position in its longitudinal direction A. In the example according to FIG. 3 anchor 31 is displaced in an upward direction, thereby closing mechanical switch 33. The starting position of the anchor 31 is defined by a return spring 35 that is connected to a longitudinal end of anchor 31.

In the off-state, i.e., upon switching off the on-voltage or supply voltage V+, the current through coil 23 stops and the energy stored in coil 23 is dissipated. Anchor 31 is then moved into its starting position by return spring 35. When anchor 31 is moved into its starting position by return spring 35 mechanical switch 33 is switched off.

In the example according to FIG. 3 anchor 31 moves upwards when the actuator is activated. However, this is only an example. The moving direction of the anchor 31 in the on-state is dependent on the orientation of the magnetic field generated by coil 23, and is therefore dependent on the winding sense of the coil and the polarity of the voltage applied between the input terminals 21, 22 in the on-state.

When the supply voltage is switched off, the energy stored in the coil 23 effects an increase of the voltage across open switching element 5. In order to prevent the switching element 5 from being damaged or destroyed a clamping arrangement 6 may be connected a load terminal and the control terminal of the switching element. Clamping arrangement 6 is adapted to control the switching state of the switching element in such a manner that the voltage across the load path of the switching element is limited to a given threshold value.

Referring to FIG. 2, switching element 5 is, for example, a MOSFET having a gate terminal as a control terminal, and having drain and source terminals as load path terminals. Clamping arrangement 6 is or includes a Zener diode connected between one of the load path terminals and the gate terminal. Besides the on-state, in which its load-path resistance assumes a minimum value, and the off-state, in which its load-path resistance assumes a maximum value, MOSFET 5 may assume intermediate states in which its load path resistance assumes a value between the minimum and maximum value. When the voltage across the load path of the MOSFET reaches a threshold value, that is dependent on the breakthrough-voltage of the Zener diode, Zener diode 6 drives MOSFET 5 into one of the intermediate switching states in order to limit the load-path voltage.

Figure 4:
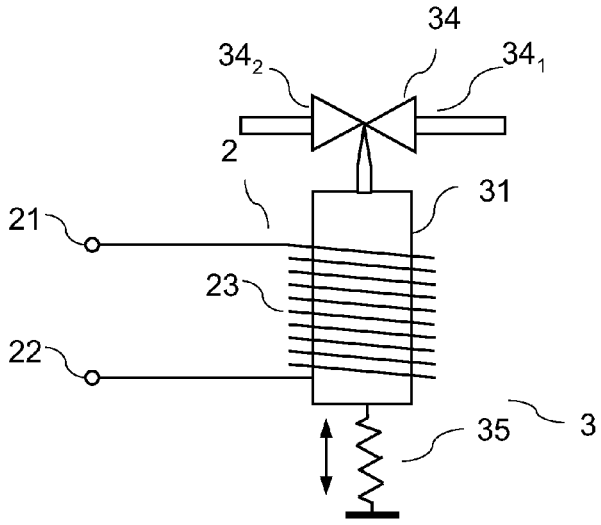
FIG. 4 schematically illustrates a second example of an electromagnetic actuator, the actuator including an electromagnet, and including an anchor for actuating a valve.

FIG. 4 schematically illustrates a further example of an electromagnetic actuator. The actuator according to FIG. 4 is different from the actuator according to FIG. 2 in that anchor 31 actuates a valve 34 that is connected between terminals $\mathbf{34}_1$, $\mathbf{34}_2$ in a fluid line. In this electromagnetic actuator anchor 31 closes the valve 34 in its on-state, and opens the valve 34 in its off-state.

An electromagnetic actuator according to FIG. 3 may, for example, be used in a relay. The electromagnetic actuator according to FIG. 4 may, for example, be used in systems in which control of a fluid flow, such as a gas flow or a liquid flow, is required. An electromagnetic actuator according to FIG. 3 may, for example, be used in an internal combustion machine for controlling the fuel flow injected into the engine.

Figure 5:
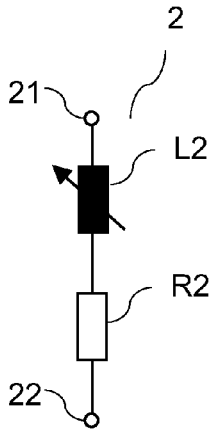
FIG. 5 illustrates the equivalent circuit diagram of the electromagnet of an electromagnetic actuator.

FIG. 5 illustrates a simplified equivalent circuit diagram of the electromagnet 2. According to this model, electromagnet 2 includes a series circuit with a resistor R2 and a variable inductance L2. Inductance L2 has an inductance value that is dependent on the activation state of the electromagnetic actuator, with the inductance values in the activated and deactivated state being different from one another.

Whether the inductance value increases or decreases when the actuator is activated is dependent on the specific configuration of the coil 23 and anchor 31 arrangement. Different examples will now be explained with reference to FIGS. 6A-6B and 7A-7B. In these Figures only the coil 23 and the anchor 31 of the actuator are illustrated.

Figure 6A:
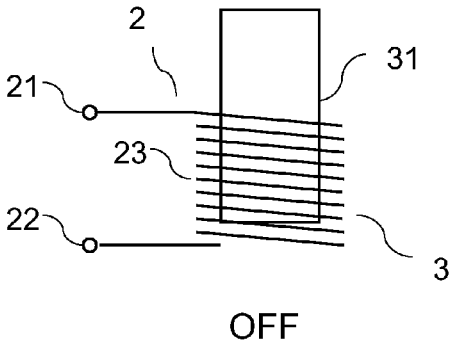
FIGS. 6A-6B illustrate the mechanical positions of the anchor in the on and off state according to a first embodiment.
Figure 6B:
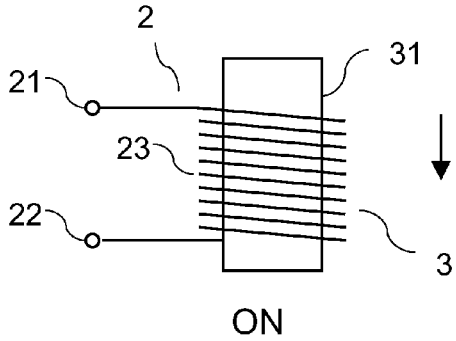

FIGS. 6A-6B illustrate an example in which in the off-state (see FIG. 6A) there is a volume within coil 31 that is not "filled" with the anchor 31. In the on-state (see FIG. 6B) the anchor moves deeper into the coil, thereby completely filling the volume within coil 31, or thereby at least filling a larger volume within coil 23 than in the off-state. In this example the inductance of the actuator arrangement increases when the actuator is activated.

Figure 7A:
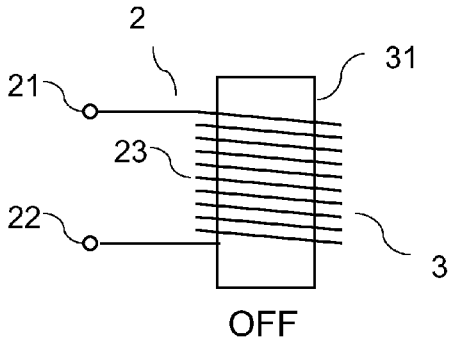
FIGS. 7A-7B illustrate the mechanical positions of the anchor in the on and off state according to a second embodiment.
Figure 7B:
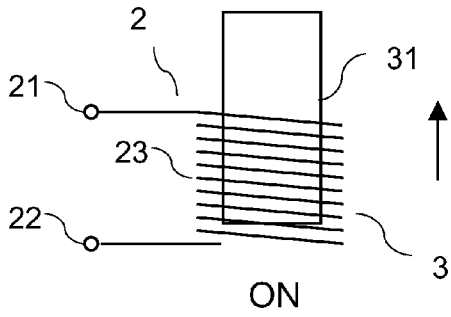

FIGS. 7A-7B illustrate an example in which in the on-state (see FIG. 7B) anchor 31 moves out from the coil 23, thereby reducing compared with the off-state (see FIG. 7A) the volume that is filled with the anchor 31 within the coil 23. Thus, the inductance value decreases when the actuator is deactivated.

The evaluation circuit 4 (see FIG. 1) is adapted to evaluate the inductance value L2 of electromagnet 2. Evaluation circuit 4 is, in particular, adapted to detect a change of the actuator's activation state whenever the inductance value L2 changes. Whether a detected change of the inductance value corresponds to a change of the actuator from the activated state into the deactivated state, or corresponds to a change of the actuator from the deactivated state into the activated state, is dependent on the kind of change that is detected, i.e., increasing or decreasing inductance value, and on the type of actuator employed. In this connection reference is made to FIGS. 6A-6B and 7A-7B and the corresponding description.

For evaluating the inductance value L2 of the electromagnet 2 different methods may be applied. According to one example a current I2 flowing through the electromagnet 2 in the on-state of the electromagnetic actuator is evaluated in order to detect a change in the inductance value, and therefore in order to detect a change in the activation state. This will be explained with reference to FIG. 8 in the following.

Figure 8:
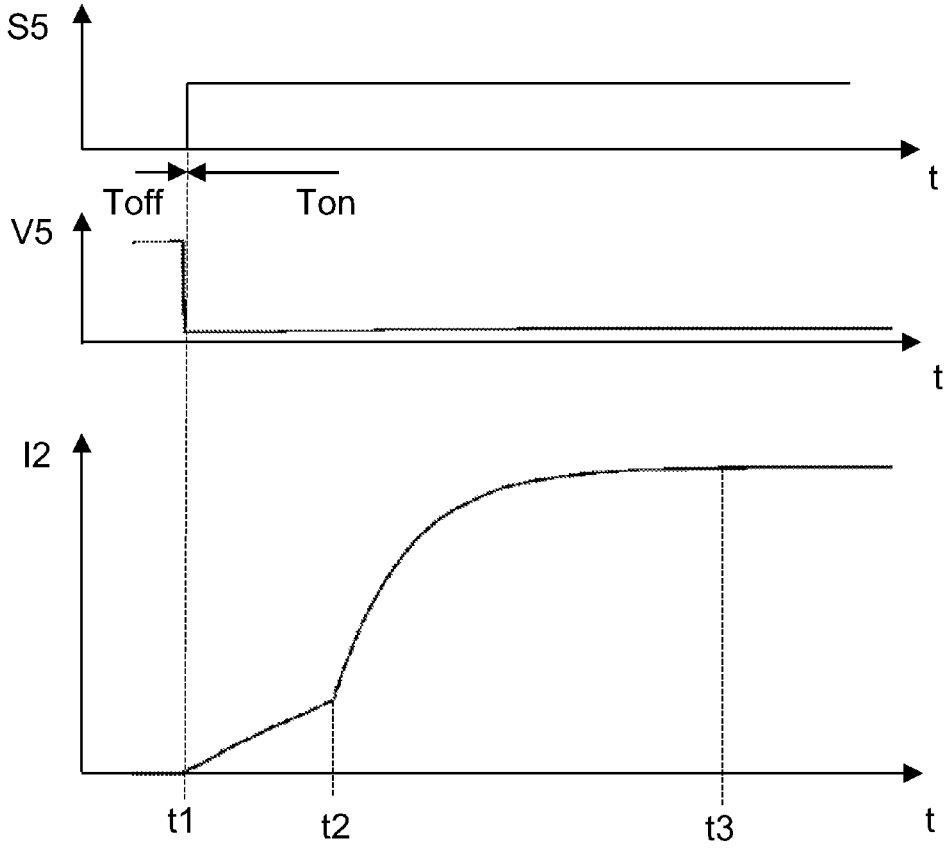
FIG. 8 illustrates the timing diagram of a current flowing through the electromagnet of an electromagnetic actuator according to a first embodiment in an on-state of the actuator.

FIG. 8 shows for an actuator according to a first example timing diagrams of the current I2 flowing through the electromagnet 2 in the on-state, of the drive signal S5 of switching element 5, and of the voltage V5 across the switching element. In FIG. 8 t1 is the time when the on-state starts, i.e., the time when the on-voltage (supply voltage V+) at the input terminals 21, 22 is switched on. Starting with this time the current I2 through the electromagnet 2 increases until at a time t3 the coil (see 23 in FIGS. 2 and 3) of the electromagnet 2 is saturated, so that no further increase in the current I2 occurs. In the example illustrated a change in the inductance value L2 during the rising period of the current I2 results in a change of the slope of the current curve at time t2. In the present example the inductance value decreases at time t2. Thus, the current slope increases at time t2. The change of the current slope at time t2 indicates a change of the inductance value L2, and therefore indicates a change in the activation state of the actuator, i.e., indicates a change from the deactivated state into the activated state. A delay time between the beginning of the on-state at time t1 and the change of the activation state, from the deactivated into the activated states, is the time difference between times t1 and t2.

According to another example the inductance value of the actuator increases when the actuator is activated. In this case the slope of the current curve decreases (not shown) at time t2.

In the off-state a change in the inductance value, and therefore a change in the activation state, may be detected by evaluating either a voltage V2 (see FIG. 1) across the electromagnet 2, or a voltage V5 (see FIG. 1) across the switching element 5 connected in series with the electromagnet 2. An example, in which the voltage V5 across the switching element 5 is evaluated, will now be explained with reference to FIG. 9.

Figure 9:
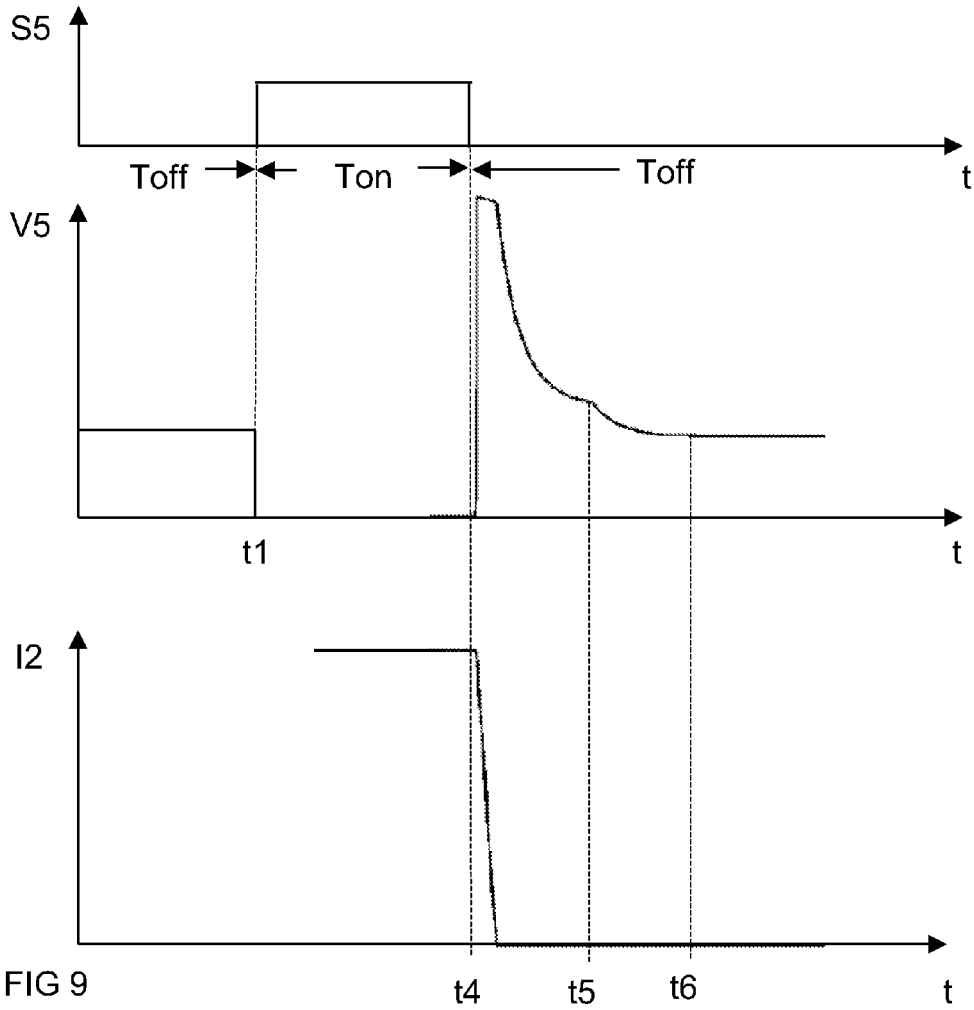
FIG. 9 illustrates the timing diagram of the voltage across a switch connected in series with the electromagnet of an electromagnetic actuator according to the first embodiment in an off-state of the actuator.

In FIG. 9 timing diagrams of the voltage V5 across switching element 5, the control signal S5 that controls the on-state and the off-state of the electromagnetic actuator 1, and the current through the actuator are illustrated. Control signal S5 may assume one of two signal levels: An on-level in which the switching element 5 is switched on; and an off-level in which switching element 5 is switched off. In the example according to FIG. 9 a high signal level represents the on-level, and a low signal level represents the off-level of control signal S5. In FIG. 9 Ton designates the on-period of the switching element 5, and Toff designates the off-period of the switching element 5. The electromagnetic actuator is in its on-state during the on-period, and is in its off-state during the off-period. In the off-state of the electromagnetic actuator a steady-state voltage across the switching element 5 corresponds to the supply voltage V+ that is present between the voltage supply terminals. This steady-state voltage is illustrated in FIG. 9 for the time period before the off-state starts at time t1.

For illustration purposes it may be assumed that during the on-state the voltage drop across the switching element 5 may be neglected as compared to the supply voltage V+, the supply voltage supplied to the input terminals 21, 22 of the electromagnet 2 therefore corresponding to the supply voltage present between the supply voltage terminals. In the on-state energy is stored in the electromagnet 2. When switching element 5 is opened at the end of the on-state, which is the beginning of the off-state, the stored energy induces a voltage between the input terminals 21, 22, this induced voltage having a reverse polarity as compared to the supply voltage applied during the on-state.

In the examples illustrated, the voltage applied to the input terminals 21, 22 is the voltage that is applied to the input terminals 21, 22 via switching element 5. In the on-state the applied voltage, which is the on-voltage, is the supply voltage V+ (if a voltage drop across switching element 5 is neglected). In the off-state the voltage (off-voltage) applied to the input terminals 21, 22 via switching element 5 is zero. The induced voltage that occurs right after the beginning of the off-state is not applied via switching element 5.

The voltage induced in the electromagnet 2 causes the voltage V5 across the switching element to rapidly increase to values above the supply voltage V+. This is illustrated in FIG. 9 at time t4 when the on-state ends and the off-state starts. The voltage is limited to a maximum value by clamping circuit 6 (see FIG. 1). Voltage V5 across switching element 5 stays above the supply voltage V+ until the energy stored in the electromagnet 2 has dissipated at time t6. After the voltage V5 has reached its maximum value at the beginning of the off-state the voltage V5 decreases, with the energy stored in the electromagnet 2 being dissipated. In this connection it should be mentioned, that the decrease in the voltage V5 from its maximum value to the value of the supply voltage V+ corresponds to the decrease in the absolute value of the voltage V2 across the electromagnet 2. The evaluation method for evaluating voltage V5 may, therefore, also be used for evaluating voltage V2 across the electromagnet 2.

In the example according to FIG. 9 the activation state of the actuator changes at time t5 between times t4 and t6. At this time t5 there is a discontinuity in the change of the voltage V5. Before time t5 voltage V5 decreases, with the rate at which voltage V5 decreases is reduced over time, i.e., the absolute value of the differential quotient dV5/dt decreases over time. At time t5 there is a discontinuity in that the differential quotient dV5/dt increases before it again decreases. In other words, the decrease of the voltage V5 temporarily increases at time t5.

The effect that results in this discontinuity will now be explained. When the activation state of the actuator changes, anchor 31 moves back into its starting position. The movement of the anchor 31 relative to the coils temporarily induces a voltage in the coil 23. This induced voltage temporarily increases the (decreasing) voltage V5, or temporarily reduces the slope of the decreasing voltage V5 before time t5.

Figure 10:
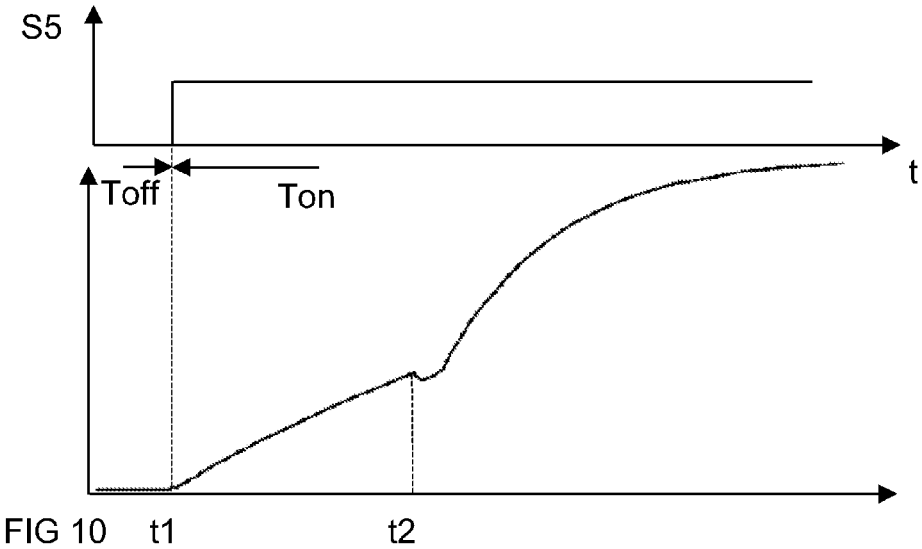
FIG. 10 illustrates the timing diagram of a current flowing through the electromagnet of an electromagnetic actuator according to a second embodiment in an on-state of the actuator.

FIG. 10 illustrates for an actuator according to a second example timing diagrams of the current I2 flowing through the electromagnet 2 in the on-state, and of the drive signal S5 of switching element 5. As in FIG. 8 t1 is the time when the on-state starts, i.e., the time when the on-voltage (supply voltage V+) at the input terminals 21, 22 is switched on. Starting with this time the current I2 through the electromagnet 2 increases until at a time t3 the coil (see 23 in FIGS. 2 and 3) of the electromagnet 2 is saturated, so that no further increase in the current I2 occurs. In the example illustrated a change in the inductance value L2 during the rising period of the current I2 results in a change of the slope of the current curve at time t2. In the present example the inductance value decreases at time t2. Thus, the current slope increases at time t2. The change of the current slope at time t2 indicates a change of the inductance value L2, and therefore indicates a change in the activation state of the actuator, i.e., indicates a change from the deactivated state into the activated state. In the example according to FIG. 10 the current I2 temporarily decreases at time t2 before it again increases (with a decreased slope). The decrease in the current I2 at time t2 is a result of the same effect that has been explained with reference to FIG. 9 and that causes a discontinuity in the voltage V5 in the off-state. When the anchor 31 moves after applying the on-voltage at the input terminals 21, 22 a voltage is induced in the coil 23. In the example according to FIG. 8 this induced voltage is too weak to influence the current I2 flowing in the coil 23. However, in the example according to FIG. 10 the voltage that is induced in the coil 23 at time t2, when the anchor 31 starts to move, is strong enough to temporarily influence the current I2 flowing in coil 23. This results in the temporary decrease of the current I2 at time t2.

In the off-state of the actuator the voltage curve of the voltage V5 across the switching element may correspond to the curve illustrated in FIG. 9.

Figure 11:
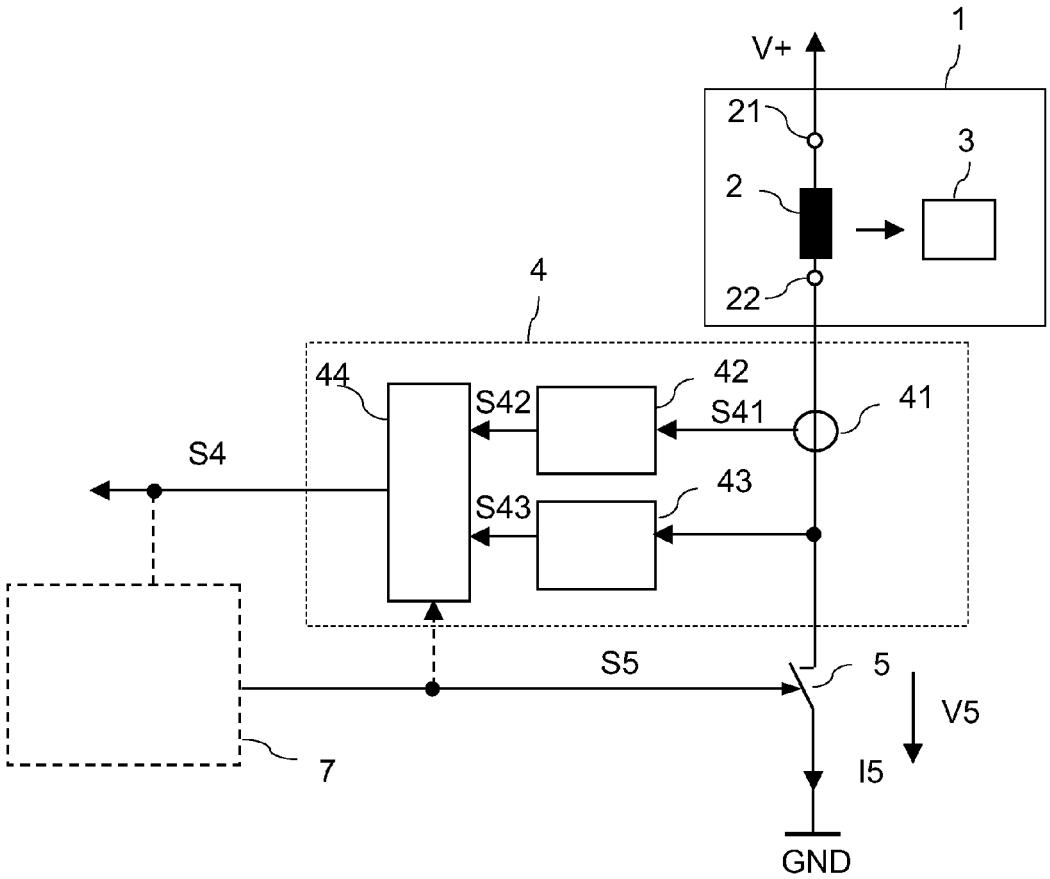
FIG. 11 illustrates a block diagram of the evaluation circuit including a current evaluation circuit, a voltage evaluation circuit, and a status signal generation circuit.

FIG. 11 illustrates a first example of an evaluation circuit 4 for detecting a change in the activation state of the electromagnetic actuator 1. This evaluation circuit 4 is adapted in the on-state to evaluate the current flowing through the electromagnet 2, and is adapted in the off-state to evaluate the voltage V5 across switching element 5. Evaluation circuit 4 generates a status signal S4, the status signal S4 being dependent on the activation state of the electromagnet 2. Status signal S4 may assume one of two signal levels: a first signal level indicating an activated state of the electromagnetic actuator 1; and a second signal level indicating a deactivated state of the electromagnetic actuator 1. The first signal level of status signal S4 will be denoted as activation level, and the second signal level will be denoted as deactivation level in the following. Status signal S4 may, for example, be received by a control circuit 7 that generates the control signal S5 for switching on and off switching element 5. Control circuit 7 is, for example, a microcontroller and is, for example, adapted to generate the control signal S5 dependent on the status signal S4. Control circuit 7 is, for example, adapted to calculate an activation time, during which electromagnetic actuator 1 is activated, and a deactivation time, during which electromagnetic actuator 1 is deactivated, from the status signal S4 and is, for example, adapted to generate control signal S5 such, that the activation or the deactivation times are equal to given set point values.

Referring to FIG. 11 evaluation circuit 4 includes a current measurement unit 41 that is adapted to measure current I2 flowing through electromagnet 2 and to provide a current measurement signal S41 that is dependent on current I2. Current measurement signal S41 is, in particular, proportional to current I2. Current measurement unit 41 may be any current measurement unit that is suitable for measuring the current through electromagnet 2 and for providing the current measurement signal S41. Current measurement unit 41 may, for example, include a shunt resistor that is connected in series with the electromagnet 2. In this case a voltage across the shunt resistor forms the current measurement signal S41.

Evaluation circuit 4 further comprises a current evaluation unit 42 that receives the current measurement signal S41 and that is adapted to evaluate the current measurement signal S41 (in order to detect a change in the activation state) in the way that has been explained with reference to FIGS. 8 and 10. Current evaluation unit 42 may, for example, include a differentiating element that calculates the differential quotient of the current measurement signal S41. Current evaluation unit 42 may further include a detection unit that detects a time period when the differential quotient during a rising period of current I2 changes as it is illustrated at times t2 FIGS. 8 and 10. Current evaluation unit 42 generates a first evaluation signal S42 that is received by status signal generation unit 44. First evaluation signal S42 includes information on those times at which current evaluation unit 42 detects a change in the activation state by evaluating current measurement signal S41. Current evaluation unit 42 is, for example, adapted to generate a signal pulse of first evaluation signal S42 each time a change in the activation state is detected.

Evaluation circuit 4 further includes a voltage evaluation unit 43 that receives the voltage V5 across the switching element 5 and that is adapted to evaluate the voltage V5 in the manner that has been explained with reference to FIG. 9. Voltage evaluation unit 43 includes, for example, a differentiating element that is adapted to differentiate voltage V5 to provide a differential quotient of voltage V5, and a detection unit that is adapted to detect a temporary increase in the (negative) differential quotient. Voltage evaluation unit 43 is adapted to generate a second evaluation signal S43 that is received by status signal generation unit 44. Voltage evaluation unit 43 is adapted to signal those times to status signal generation unit 44 in which a change in the activation state is detected. For this purpose voltage evaluation circuit 43, for example, generates a signal pulse of the second evaluation signal S43 each time such change in the activation state is detected.

Figure 12:
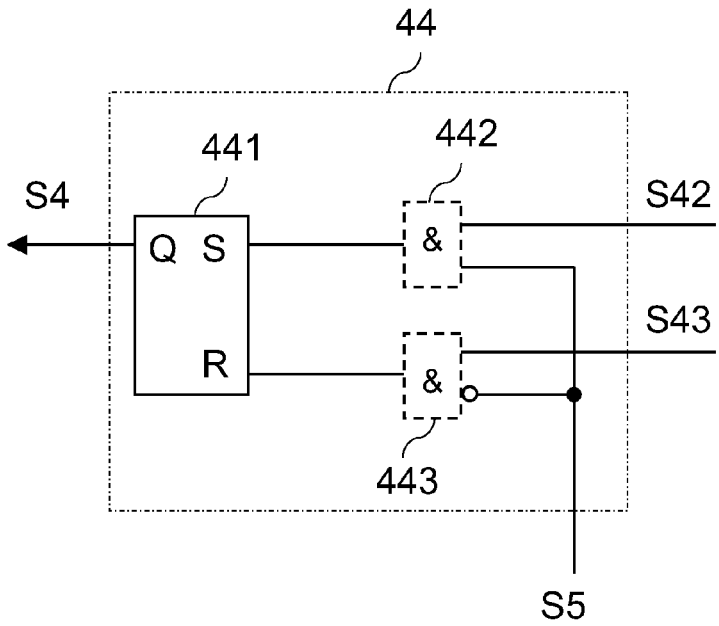
FIG. 12 illustrates an example of the status signal generation circuit in detail.

Referring to FIG. 12 status signal generation unit 44 may include a flip-flop 441 that receives first evaluation signal S42 at its set-input S, and second evaluation signal S43 at its reset-input R. In order to avoid the first evaluation circuit 42 from affecting the status signal S4 during the off-state, and in order to prevent the second evaluation unit 43 from affecting the status signal S4 during the on-state optional AND gates 442, 443 (shown in dashes lines) are connected upstream to the set and reset inputs S, R. First AND gate 442 receives the first evaluation signal S42 and the control signal S5 at non-inverting inputs, and second AND gate 443 receives the second evaluation signal S43 at a non-inverting input and control signal S5 at an inverting input. In this arrangement flip-flop 441 can only be set by the first evaluation signal S42 during the on-state, when control signal S5 assumes an on-level, and flip-flop 441 can only be reset by second evaluation signal S43 during the off-state, when control signal S5 assumes an off-level.

Figure 13:
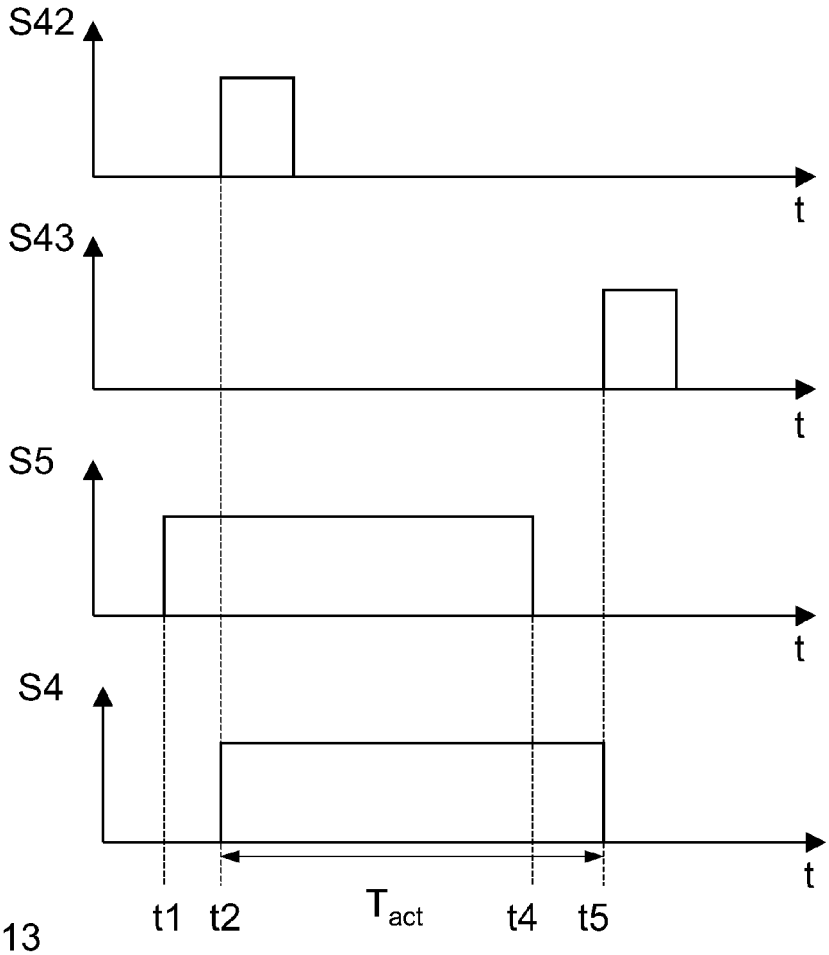
FIG. 13 illustrates timing diagrams of signals occurring in the status signal generation circuit.

The functionality of the evaluation circuit 4 according to FIG. 11 will now be explained with reference to FIG. 13 in which timing diagrams of the first and second evaluation signals S42, S43, the control signal S5 and the status signal S4 are illustrated. In FIG. 13, as in FIGS. 8, 9 and 10, t1 denotes the beginning of an on-state, and t4 denotes the end of the on-state and the beginning of the off-state. t2 is the time when a change in the activation state during the on-state is detected by current evaluation circuit 42. First evaluation signal S42 therefore has a signal pulse at time t2. At this time flip-flop 441 is set so that status signal S4 assumes its activation level, which is a high-level in the example according to FIG. 13. At time t5 after the beginning of the off-state voltage evaluation unit 43 detects a change in the activation state. At this time voltage evaluation unit 43 generates a signal pulse of the second evaluation signal S43. At this time flip-flop 441 is reset, so that status signal S4 assumes its deactivation level, which is a low-level in the example according to FIG. 13. $T_{act}$ in FIG. 13 denotes the activation time, which is the time when electromagnetic actuator is activated. Dependent on the delay times between the beginning of the on-state (at time t1) and the beginning of the activation state (at time t2), and the delay time between the beginning of the off-state (at time t4) and the beginning of the deactivation state (at time t5). Activation time $T_{act}$ may be different from the duration Ton of the on-state. With a given on-time t1-t4 the activation time $T_{act}$ may change with ambient temperature of the actuator.

Figure 14:
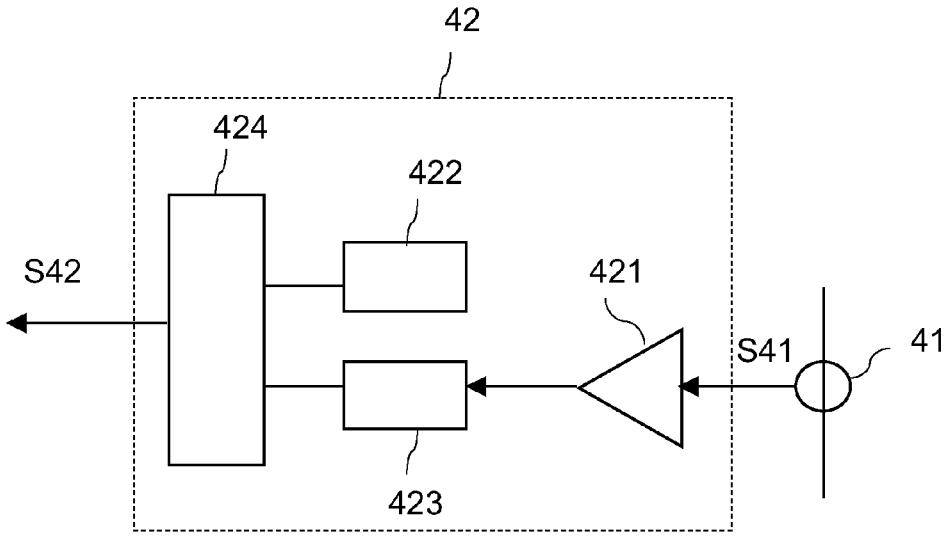
FIG. 14 illustrates an example of the current evaluation circuit in detail.

FIG. 14 schematically illustrates an example of the current evaluation unit 42. The current evaluation unit 42 according to the example includes a first storage device 422 for storing a current evaluation pattern. Current evaluation pattern includes at least two current measurement values that are representative of current values that occur in a time period in which a change in the activation state occurs. Current evaluation pattern may, for example, include a number of current measurement values that correspond to current values occurring within a given time window that includes time t2 in FIGS. 8 and 10. Current evaluation unit 42 according to FIG. 14 further includes a second storage device 423 for storing current measurement values obtained from current measurement unit 41 via a sample-and-hold element 421. The first and second storage devices 422, 423 may be digital storage devices. In this case current measurement unit 41 may be realized so as to provide digital current measurement values. In another example current measurement unit 41 is an analog current measurement unit, and an analog-to-digital converter is included in the sample-and-hold element 421, so that the sample-and-hold element 421 provides digital current measurement values.

The second storage device 423 is, for example, a shift register, the number of current measurement values stored in the second storage device 423, for example, corresponding to the number of values the current evaluation pattern stored in the first storage device 422 includes. A comparator unit 424 compares the current measurement pattern stored in the second storage device 423 with the current evaluation pattern and generates the first evaluation signal S42 dependent on the comparison result. According to an example comparator unit 424 generates a signal pulse of the first evaluation signal S42 each time a current measurement pattern stored in the second storage device 423 equals the current evaluation pattern stored in the first storage device 422. The current evaluation pattern stored in storage element 422 is characteristic of a given actuator, i.e., the evaluation pattern stored in storage device 422 is different for different actuators.

Figure 15:
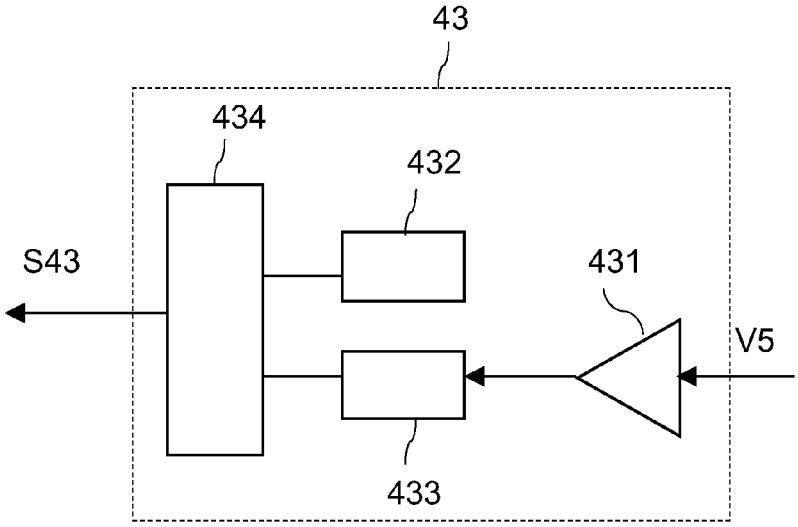
FIG. 15 illustrates an example of the voltage evaluation circuit in detail.

The voltage evaluation unit 43 according to FIG. 11 may be realized in a manner similar to the current evaluation unit 42 illustrated in FIG. 14. FIG. 15 illustrates an example of such voltage evaluation unit 43. The voltage evaluation unit 43 includes a first storage device 432 for storing a voltage evaluation pattern. Voltage evaluation pattern includes at least two voltage measurement values that are representative of voltage values that occur in a time period in which a change in the activation state occurs. Voltage evaluation pattern may, for example, include a number of voltage measurement values that correspond to voltage values occurring in a time window that includes time t5 FIG. 9. Voltage evaluation unit 43 according to FIG. 15 further includes a second storage device 433 for storing voltage values obtained by sampling voltage V5 using a sample-and-hold element 431.

The second storage device 433 is, for example, a shift register, the number of voltage measurement values stored in the second storage device 433, for example, corresponding to the number of values the voltage evaluation pattern stored in the first storage device 432 includes. A comparator unit 434 compares the voltage measurement pattern stored in the second storage device 433 with the voltage evaluation pattern and generates the second evaluation signal S43 dependent on the comparison result. According to an example comparator unit 434 generates a signal pulse of the second evaluation signal S43 each time a voltage measurement pattern stored in the second storage device 433 equals the voltage evaluation pattern stored in the first storage device 432.

What is claimed is:

1. A circuit arrangement comprising:

an electromagnetic actuator, the electromagnetic actuator comprising an electromagnet having an inductance and an anchor mechanically controlled by the electromagnet; and an evaluation circuit coupled to the electromagnet, the evaluation circuit configured to generate an activation state signal dependent on an inductance value of the inductance, the activation state signal being indicative of a change in an activation state of the electromagnetic actuator and being based on a differential quotient of a voltage measurement.

2. The circuit arrangement of claim 1, wherein the evaluation circuit comprises:

a current measurement unit configured to measure a current through the electromagnet; and a current evaluation unit configured to detect the change in the activation state at a time when a slope of the current changes in an on-state.

3. The circuit arrangement of claim 2, wherein the current evaluation unit further comprises:

a first storage device adapted to store at least one current evaluation pattern that is representative of the current through the electromagnet in a time period that includes the change in the activation state;

a second storage device adapted to store current measurement patterns obtained through the current measurement unit by measuring the current through the electromagnet; and a comparator adapted to compare the current measurement patterns with the at least one current evaluation pattern and to generate a comparison signal.

4. The circuit arrangement of claim 1, wherein the evaluation circuit comprises:

a voltage evaluation unit configured to detect the change in the activation state at a time when a rate at which a voltage change has a discontinuity in an off-state.

5. The circuit arrangement of claim 4, wherein the voltage evaluation unit further comprises:

a first storage device adapted to store at least one voltage evaluation pattern that is representative of the voltage across the electromagnet or across a switch in a time period that includes the change in the activation state;

a second storage device adapted to store voltage measurement patterns obtained by measuring the voltage across the electromagnet or across the switch; and a comparator adapted to compare the voltage measurement patterns with the at least one voltage evaluation pattern and for generating a comparison signal.

6. The circuit arrangement of claim 1, further comprising a switching element connected in series with the electromagnetic actuator.

7. The circuit arrangement of claim 6, wherein the evaluation circuit is coupled to the switching element.

8. The circuit arrangement of claim 6, wherein a clamping arrangement is connected between the electromagnetic actuator and a control terminal of the switching element.

9. A circuit comprising:

an electromagnetic actuator comprising an electromagnet having an inductance and an anchor mechanically controlled by the electromagnet; and an evaluation circuit coupled to the electromagnet, the evaluation circuit configured to generate an activation state signal dependent on an inductance value of the inductance, wherein the evaluation circuit comprises a current evaluation unit configured to calculate a differential quotient for a current in an on-state of the electromagnetic actuator; and a voltage evaluation unit configured to calculate a differential quotient for a voltage in an off-state of the electromagnetic actuator.

10. The circuit of claim 9, further comprising a switching element connected in series with the electromagnetic actuator.

11. The circuit of claim 10, wherein the evaluation circuit is coupled to the switching element.

12. The circuit of claim 10, wherein a clamping arrangement is connected between the electromagnetic actuator and a control terminal of the switching element.

13. A method for determining a change in an activation state of an electromagnetic actuator, the electromagnetic actuator comprising an electromagnet having an inductance, and an anchor mechanically controlled by the electromagnet, the method comprising:

calculating a differential quotient of a current flowing through the electromagnet in an on-state of the electromagnetic actuator;

calculating a differential quotient of a voltage across the electromagnet in an off-state of the electromagnetic actuator; and evaluating an inductance value of the inductance.

14. A method for determining a change in an activation state of an electromagnetic actuator, the electromagnetic actuator comprising an electromagnet having an inductance, and an anchor mechanically controlled by the electromagnet, the method comprising:

switching from an on-state to an off-state that causes the anchor to move in its off-state position; and detecting the change in the activation state of the electromagnetic actuator at a time when a rate at which a voltage changes across the electromagnet or a switch connected in series with the electromagnet has a discontinuity.

15. The method of claim 14, further comprising:

obtaining voltage measurement patterns by measuring the voltage across the electromagnet;

comparing the voltage measurement patterns with at least one voltage evaluation pattern that is representative of the voltage across the electromagnet during a time period that includes the change in the activation state; and detecting the change in the activation state when one of the voltage measurement patterns equals the at least one voltage evaluation pattern.

16. A method for determining a change in an activation state of an electromagnetic actuator, the electromagnetic actuator comprising an electromagnet having an inductance, and an anchor mechanically controlled by the electromagnet, the method comprising:

applying an off-voltage that causes the electromagnetic actuator to be in an off-state;

evaluating a voltage across a switching element in the off-state, the switching element coupled in series with the electromagnetic actuator; and detecting the change in the activation state in the off-state at a time when a rate at which the voltage decreases has a discontinuity.

17. The method of claim 16, further comprising:

obtaining voltage measurement patterns by measuring the voltage across the electromagnet;

comparing the voltage measurement patterns with at least one voltage evaluation pattern that is representative of the voltage across the switch during a time period that includes the change in the activation state; and detecting the change in the activation state in the off state when one of the voltage measurement patterns equals the at least one voltage evaluation pattern.

18. The method of claim 16, further comprising:

applying an on-voltage that causes the electromagnetic actuator to be in an on-state;

evaluating a current through the electromagnet in the on-state; and detecting the change in the activation state in the on-state at a time when a slope of the current changes.

19. The method of claim 18, further comprising:

obtaining current measurement patterns by measuring the current through the electromagnet;

comparing the current measurement patterns with at least one current evaluation pattern, wherein the at least one current evaluation pattern that is representative of the current through the electromagnet in a time period that includes the change in the activation state in the on-state; and detecting the change in the activation state in the on-state when one of the current measurement patterns equals the at least one current evaluation pattern.

* * * * *